US007297889B2

(12) United States Patent
Bornhorst et al.

(10) Patent No.: US 7,297,889 B2
(45) Date of Patent: Nov. 20, 2007

(54) ROTARY SWITCH

(75) Inventors: Dieter Bornhorst, Stockach (DE); Klaus Mueller, Aach (DE); Hans-Joachim Frohne, Lehre (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 11/599,215

(22) Filed: Nov. 14, 2006

(65) Prior Publication Data

US 2007/0119694 A1 May 31, 2007

(30) Foreign Application Priority Data

Nov. 17, 2005 (DE) ..... 20 2005 018 008 U

(51) Int. Cl.

| | |
|---|---|
| ***H01H 19/00*** | (2006.01) |
| ***H01H 19/14*** | (2006.01) |
| ***H01H 21/00*** | (2006.01) |
| ***H01H 3/08*** | (2006.01) |

(52) U.S. Cl. ..... 200/336; 200/564

(58) Field of Classification Search ..... 200/336
See application file for complete search history.

(56) References Cited

U.S. PATENT DOCUMENTS 3,360,757 A * 12/1967 Wahlberg ..... 338/162
6,028,502 A * 2/2000 McSwiggen ..... 338/167
6,041,868 A * 3/2000 Matus et al. ..... 172/2
2005/0075741 A1* 4/2005 Altmann et al. ..... 700/83

FOREIGN PATENT DOCUMENTS

| | | |
|---|---|---|
| DE | 3533057 | 3/1987 |
| DE | 19936385 | 2/2001 |
| DE | 19923425 | 5/2001 |
| DE | 10138463 | 3/2003 |
| EP | 1231622 | 8/2002 |
| EP | 1505614 | 2/2005 |
| GB | 1294921 | 11/1972 |
| JP | 58064522 | 4/1983 |
| JP | 09306708 | 11/1997 |

* cited by examiner

*Primary Examiner*—Elvin Enad
*Assistant Examiner*—Lheiren Mae A. Anglo
(74) *Attorney, Agent, or Firm*—Tarolli, Sundheim, Covell & Tummino LLP

(57) ABSTRACT

A rotary switch is disclosed which has a central handle (12) which is rotatable about a central axis (Z), a ring-shaped shield (16) surrounding the handle (12), a rotary button (18) which is arranged on the shield (16) and is rotatable about an axis (V) offset from and parallel to said central axis (Z), and a potentiometer (28) which is adjustable by means of the rotary button (18).

The potentiometer (28) is radially spaced from the offset axis (V), and is coupled with the rotary button (18) by means of a gear (24, 26). The potentiometer (28) is offset radially inwards from the offset axis (V) towards the central axis (Z).

11 Claims, 2 Drawing Sheets

ROTARY SWITCH

BACKGROUND OF THE INVENTION

The invention relates to a rotary switch.

When operating switches, it is sometimes comfortable for the user when related functions can be carried out by means of operating elements which are closely adjacent to each other. For example, an adjustment means for the illumination range, i.e. the angle of the headlights, is also to be provided in the immediate vicinity of a switch by which the various light functions of the vehicle are selected. In doing this, however, the available structural space must always be taken into account. This is extremely limited, particularly in vehicles for example on the instrument panel of a passenger car.

SUMMARY OF THE INVENTION

The invention provides a rotary switch with a central handle which is rotatable about a central axis, a ring-shaped shield surrounding the handle, a rotary button which is arranged on the shield and is rotatable about an axis offset from and parallel to the central axis, and a potentiometer which is adjustable by means of the rotary button. The potentiometer is arranged radially spaced from the offset axis and is coupled with the rotary button by means of a gear. In this way, the total space required for the rotary switch with the additional rotary button can be distinctly reduced and the available installation space can be utilized better.

In particular, it is advantageous to offset the potentiometer radially inwards from the rotary button towards the central axis because then, due to the gear, only the radial space requirement of the rotary button, but not also that of the potentiometer connected therewith, has to be taken into account.

The rotary button is advantageously associated with an illumination range regulator of a vehicle. In a preferred embodiment, the rotary button is mounted to be axially shiftable between a position retracted in the shield and a position projecting from the shield, yet remaining coupled with a ratchet of the gear for joint rotation. The arrangement of the rotary button so as to be able to be retracted is advantageous when a function only has to be utilized occasionally; the adjustment of the headlight range is an example.

The handle may be another rotary button and may serve, for example, as a light switch in a vehicle.

In a preferred embodiment of the invention, the gear is a step-up gear. In this way, a small amount of rotation may suffice for adjustment over a large range.

The rotary button may be coupled with a pin element which is fixedly connected with a first ratchet of the gear, thereby reducing the number of components. Moreover, the radial distance of the potentiometer from the rotary button can be bridged in a simple manner via the diameter of the first ratchet of the gear.

The potentiometer may be fixedly connected with a second ratchet of the gear. Of course, it is possible to use additional ratchet wheels or other suitable structural elements to achieve the desired transmission or bridging of the distance between the potentiometer and the rotary button.

In an embodiment where the rotary switch comprises a printed circuit board, the rotary button is arranged above and the potentiometer is arranged underneath the printed circuit board. Not only a radial, but also an axial staggering between the potentiometer and the rotary button is achieved through this, whereby the small amount of available space can be utilized even better.

The resistance track of the potentiometer may have a coding which maps discrete rotational positions of the rotary button with respective angular ranges of the resistance track in which the resistance value remains substantially constant.

SHORT DESCRIPTION OF DRAWINGS

The invention is described in further detail below with reference to the enclosed drawings in relation to a preferred embodiment. In the drawings.

DETAILED DESCRIPTION OF PREFERRED EMBODIMENT

Figure 1:
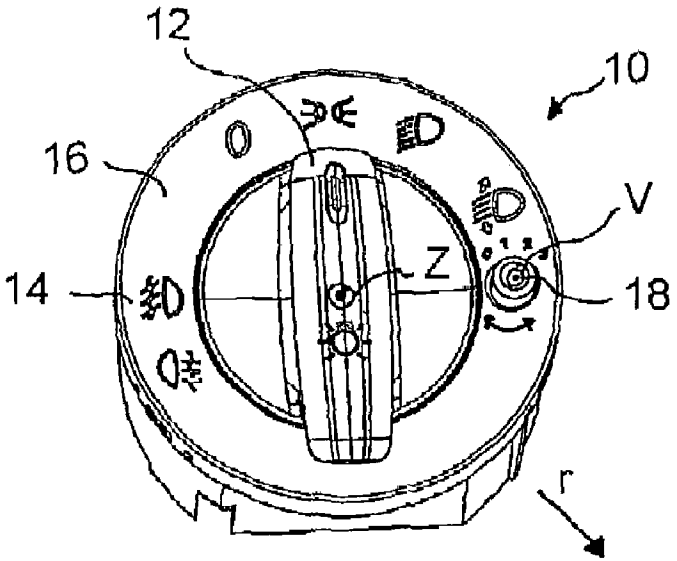
FIG. 1 shows a perspective view of a rotary switch according to the invention.

The rotary switch 10 shown in FIG. 1 operates light functions in a passenger car, although it is not limited to this application.

The rotary switch 10 comprises a central handle 12, here a rotary button, which is rotatable about a central axis Z into various discrete predetermined positions which are marked with the corresponding symbols 14 for the various settings of the vehicle lighting. The symbols 14 are applied onto a ring-shaped shield 16 surrounding the central handle 12, the shield 16 likewise being part of the rotary switch 10.

A rotary button 18 projects through the shield 16, the radial extent of the rotary button 18 being smaller than the radial dimension of the shield 16, so that the rotary button 18, as shown in FIG. 1, can be placed on the shield 16.

Figure 2:
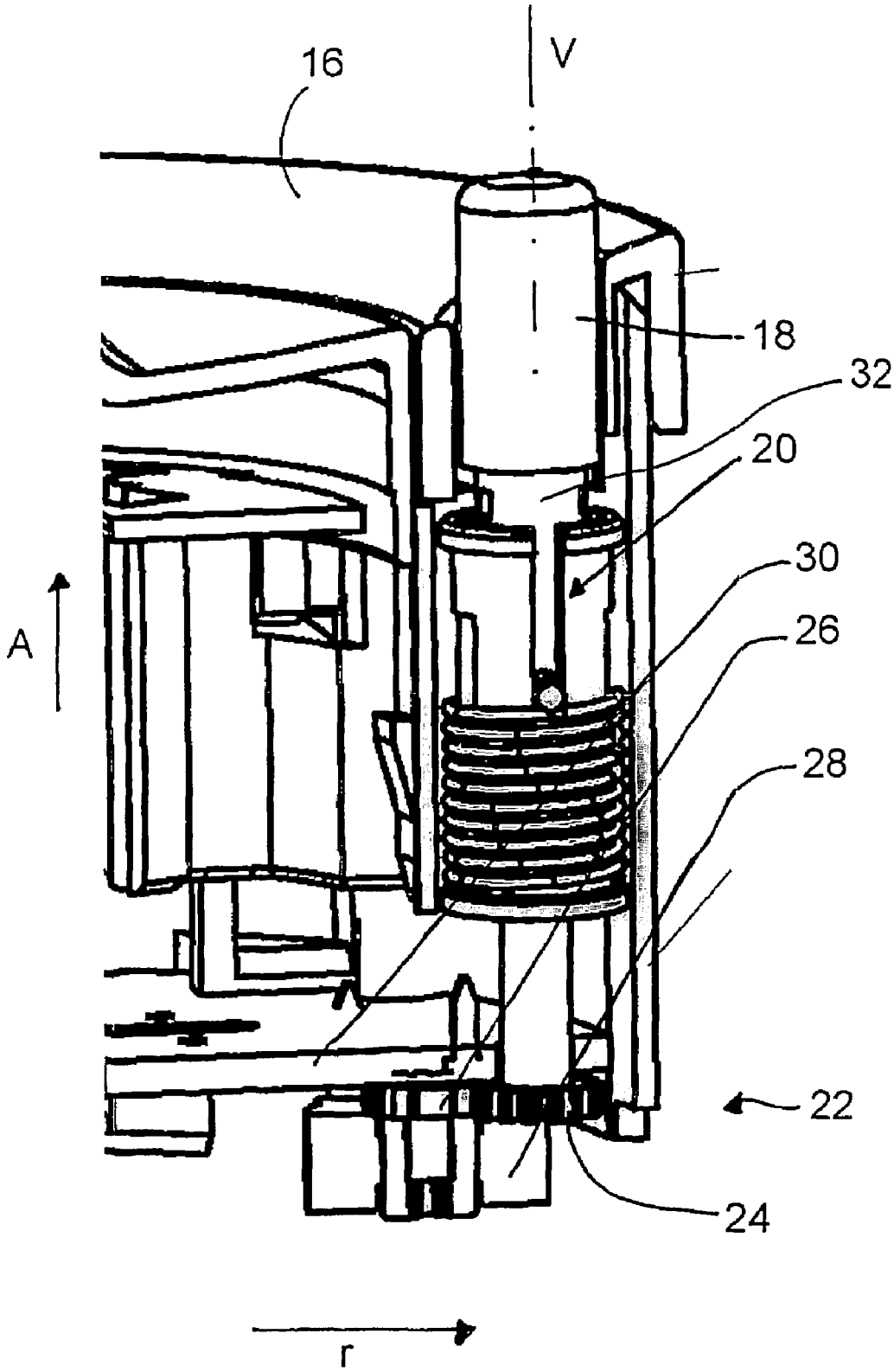
FIG. 2 shows a diagrammatic sectional view of a rotary switch according to the invention.

The rotary button 18 is mounted so as to be able to be retracted in a known manner. On axial pressure (into the plane of the drawing in FIG. 1), a lock, e.g. similar to a ballpoint pen mechanism, is released, whereupon the rotary button 18 is raised from the plane of the shield 16 by means of elastic force. This is shown in FIG. 2. The rotary button 18 can then be rotated about its axis, which is designated here as offset axis V. In response to an axial pressure, it engages in a retracted position, its top end lying approximately flush with the surface of the shield 16.

In the rotary switch 10 which is shown, the illumination range of the headlights, i.e. their inclination, is adjusted by means of the rotary button 18.

To this end, the rotary button 18 is connected with a potentiometer 28 via a sleeve 20.

The potentiometer 28 has a substantially greater dimension in the radial direction r than the rotary button 18, and particularly also a greater dimension than the space available on the shield 16. However, the potentiometer 28 is offset radially by a distance with respect to the rotary button 18 and accordingly with respect to the offset axis V, radially inwards towards the central axis, so that the radial extent of the potentiometer 28 is non-critical and the potentiometer 28 does not project radially over the outer periphery of the shield 16. A rotary button 18 must merely be used, which fits with the shield 16.

The rotary switch 10 also includes a printed circuit board 30 which holds various electronic components and, for example, passes the value which is set at the potentiometer 28 on to a function unit which adjusts the inclination of the headlights. The potentiometer 28 is arranged in the axial direction A of the rotary switch 10 underneath the printed circuit board 30, whereas the rotary button 18 is placed in the axial direction A above the printed circuit board 30.

Figure 3:
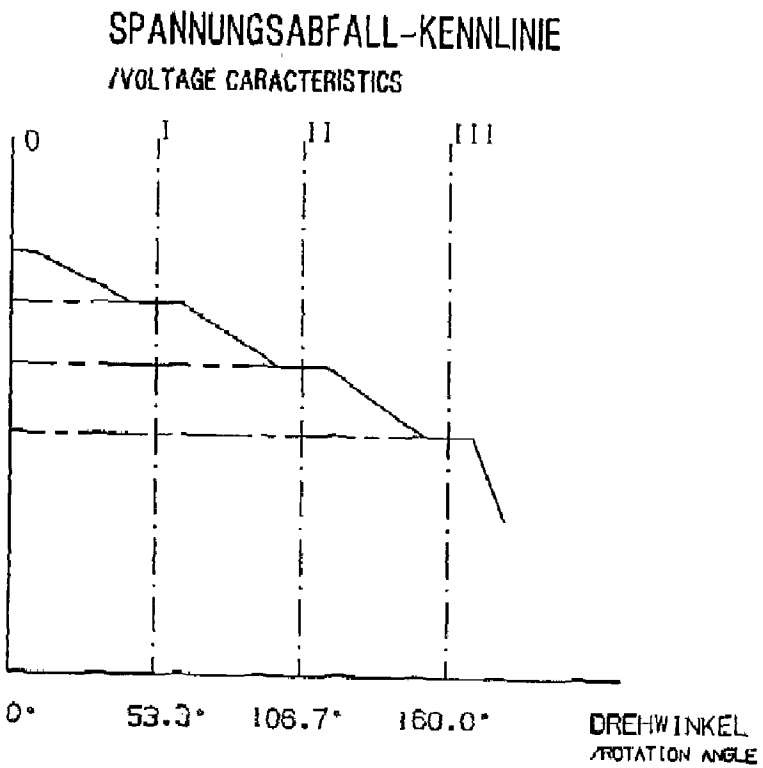
FIG. 3 shows a characteristic of a potentiometer of a rotary switch according to the invention.

As shown in FIG. 3, the characteristic of the potentiometer 28 has various discrete plateaus each of which maps with a particular rotation angle range of the rotary button 18. The resistance track of the potentiometer is coded so that discrete rotational positions over a rotation angle range have a substantially constant resistance value. The potentiometer therefore can provide different voltage values, which are then passed on to a control system for the illumination range of the headlights.

The sleeve 20 which connects the rotary button 18 with the potentiometer 28 comprises a step-up gear 22 with a first ratchet wheel 24 and a second ratchet wheel 26. The rotary button 18 is coupled with the input shaft of the step-up gear 22 for joint rotation, but so as to be axially movable. In addition, the sleeve 20 comprises pin element 32 which runs axially, which is also here a part of the retraction mechanism 34 for the rotary button 18. The pin element 32 (e.g. a rod or a tube) is connected at one end with the rotary button 18 for joint rotation, and is fixedly connected at the other end with the first ratchet wheel 24. The first ratchet wheel 24 meshes with the second ratchet wheel 26 which is fixedly connected with the axis of the potentiometer 28.

The sensitivity of the rotary movement of the rotary button 18 is set by selecting the size and the number of teeth of the ratchet wheels 24, 26.

The rotary button 18, the pin element 32 and the ratchet wheel 24 may be made from plastic, just as most other parts of the switch.

The invention claimed is:

1. A rotary switch, comprising a central handle which is rotatable about a central axis, a ring-shaped shield surrounding the central handle, a rotary button which is arranged on the shield and is rotatable about an axis offset from and parallel to said central axis, and a potentiometer which is adjustable by means of the rotary button, said potentiometer being radially spaced from the offset axis, and being coupled with said rotary button by means of a gear.

2. The rotary switch according to claim 1, wherein said potentiometer is offset radially inwards from the offset axis towards the central axis.

3. The rotary switch according to claim 1, wherein said rotary button is mounted to be axially movable between a position retracted in the shield and a position protruding from the shield while remaining coupled to an input ratchet of said gear for joint rotation.

4. The rotary switch according to claim 1, wherein said rotary button is associated with a light range regulator of a vehicle.

5. The rotary switch according to claim 1, wherein said central handle is also a rotary button.

6. The rotary switch according to claim 1, wherein said central handle is associated with a light switch in a vehicle.

7. The rotary switch according to claim 1, wherein said gear is a step-up gear.

8. The rotary switch according to claim 7, wherein said rotary button is coupled with a pin element which is fixedly connected with the first ratchet of the gear.

9. The rotary switch according to claim 1, wherein said potentiometer has an axis fixedly connected with a second ratchet of the gear.

10. The rotary switch according to claim 1, and comprising a printed circuit board, the rotary button being arranged above and the potentiometer being arranged underneath the printed circuit board.

11. The rotary switch according to claim 1, wherein said potentiometer has a resistance track coded so as to map discrete rotational positions of the rotary button with respective angular ranges of the resistance track in which the resistance value remains substantially constant.

* * * * *